US005336963A

United States Patent [19]

Haga et al.

[11] Patent Number: 5,336,963

[45] Date of Patent: Aug. 9, 1994

[54] COLOR CATHODE-RAY TUBE

[75] Inventors: Akira Haga, Sendai; Hiroshi Nasuno, Kurihara; Takeo Fujimura, Nagaokakyo, all of Japan

[73] Assignees: Mitsubishi Denki Kabushiki Kaisha, Tokyo; Tohoku Gakuin University, Sendai, both of Japan

[21] Appl. No.: 140,711

[22] Filed: Oct. 22, 1993

Related U.S. Application Data

[63] Continuation of Ser. No. 892,589, Jun. 3, 1992, abandoned.

[30] Foreign Application Priority Data

Jun. 11, 1991 [JP] Japan ..... 3-138728

[51] Int. Cl.[5] ..... H01J 29/07

[52] U.S. Cl. ..... 313/402; 313/407

[58] Field of Search ..... 313/402, 407

[56] References Cited

U.S. PATENT DOCUMENTS 4,019,085 4/1977 Sakata ..... 313/407 X
4,229,675 10/1980 Matsuki et al. ..... 313/402
4,385,256 5/1983 Tokita et al. ..... 313/407
4,580,076 4/1986 Shimoma et al. ..... 313/402
4,858,016 8/1989 Suehiro et al. ..... 358/246

FOREIGN PATENT DOCUMENTS 0217473 4/1987 European Pat. Off. .
0403010 12/1990 European Pat. Off. .
3807125 9/1988 Fed. Rep. of Germany .

*Primary Examiner*—Sandra L. O'Shea

[57] ABSTRACT

In a color cathode-ray tube having a shadow mask disposed to face a phosphor screen and having apertures for passage of an electron beam, and a frame for reinforcing tile periphery of the shadow mask, a magnetic shield comprises strips of magnetic material each having a first end fixed to the frame and a second end disposed closer to the electron gun. Because of the elongated shape, the strips are magnetized easily only in the direction of their length. As a result, an external magnetic field parallel to the strips, and hence with the tube axis, is reduced or canceled. Moreover, if each strip is bent near its second end so that the second end is directed toward a horizontal plane containing the tube axis, an external magnetic field in the direction in which the second end is directed is enhanced. This will further reduce deviation of the electron beam path In the horizontal direction.

20 Claims, 11 Drawing Sheets

COLOR CATHODE-RAY TUBE

This application is a continuation, of application Ser. No. 07,892,589 filed on Jun. 3, 1992, which is now abandoned.

BACKGROUND OF THE INVENTION

The present invention relates to a color cathode ray tube of the shadow mask type that has a magnetic shield for preventing for example color contamination due to deviation of the electron beam caused by an external magnetic field such as terrestrial magnetism.

In a color cathode ray tube with a built-in shadow mask, when the electron beam deviates under the influence of an external magnetic field, such as terrestrial magnetism, color contamination or other undesirable phenomenon occurs because undesired parts of a phosphor screen is made to emit light. To eliminate the effect of the external magnetic field, an internal magnetic shield is mounted along the inner wall of a funnel, adjacent the edges of a generally rectangular shadow mask.

FIG. 11 is a sectional view of such a color cathode ray tube in the prior art. In describing the color cathode ray tube, the term "Z-axis" is used to mean the tube axis which is perpendicular to the shadow mask and passing the center of the shadow mask, the term "X-axis" is used to mean the axis orthogonal to the Z-axis and parallel to the longer sides (horizontally extending sides, i.e., the top and the bottom sides) of the shadow mask, and the term "Y-axis" is used to mean the axis orthogonal to the Z-axis and the X-axis and parallel to the shorter sides (vertically extending sides , i.e., the right and the left sides) of the shadow mask. Moreover, the term "front" is used to mean the direction toward the face plate of the cathode ray tube, and the term "rear" is used to mean the direction toward the electron gun.

The cathode ray tube shown in FIG. 11 comprises a glass envelope 1 made up of a neck 1*a*, a funnel 1*b* and a face plate or front panel 1*c*. An electron gun 2 is disposed in the neck 1*a*, a phosphor screen 3 formed of phosphors emitting light of red, green and blue are provided on the inner surface of the front panel 1*c* in a mosaic fashion. A rectangular shadow mask 4 is disposed to face the phosphor screen 3, and is provided with apertures 6 for passage of electron beams 9, as shown in FIG. 12.

A rectangular frame 5 comprises a parallel part 5*a* and a normal part 5*b*. The parallel part 5*a* is flat, parallel with a skirt 1*ca* of the Front panel 1*c*, and extends along the edges of the phosphor screen 3. The normal part 5*b* is flat, connected to the rear edge of the parallel part 5*a* (that side of the parallel part 5*a* which is facing the electron gun 2) and extends therefrom inward, normal to the axis, denoted by Z, of the tube 1.

The cross section of the rectangular frame 5 is therefore L-shaped.

The parallel part 5*a* has a width smaller than the dimension of the skirt 1*ca* in the direction of the tube axis Z so that it is accommodated in the skirt 1*ca*.

The edges of the shadow mask 4 are fixed, by means of welding or the like, to the sides 5*a* of the frame 5, so that the shadow mask 4 is reinforced.

Springs 7 have one end fixed to the parallel part 5*a* of the frame 5. The shadow mask 4, the frame 5 and the springs 7 together form a shadow mask structure 20.

The springs 7 have holes at their other ends engaged with pins (not shown) erected on the inner surface of the respective sides of the skirt 1*ca*, and the shadow mask 4 and the phosphor screen 3 face each other, being separated by a predetermined distance.

An inner magnetic shield 8 is formed from a thin sheet and formed to have a shape of a frustum of pyramid or prismold having side surfaces extending along the inner surface of the funnel 1*b*.

The periphery 8*a* of the front edge of the inner magnetic shield 8 are fixed, by means of welding or the like, to the rear side of the normal part 5*b* of the frame 5.

The electron beam 9 emitted from the electron gun 2 is scanned over the range indicated by chain lines 9*a* and 9*b* in FIG. 11, and the electron beam having passed the apertures 6 impinges on the phosphor screen 3 to cause selective light emission from the phosphors.

When the color cathode ray tube is in an environmental magnetic field, such as terrestrial magnetism, the path of the electron beam 9 is bent. Such influence of the environmental magnetic field is removed or suppressed by the inner magnetic shield 8. That is, in the space enclosed by the inner magnetic shield 8, the environmental magnetic field is reduced, so the bending of the path of the electron beam 9 is reduced, and the deviation in the position of impingement onto the phosphor screen 3 is reduced, and the color contamination is therefore reduced.

Observation of the magnetic shielding effect of the inner magnetic shield 8 reveals that when the color cathode ray tube is disposed to face the east or the west (disposed in the E direction or the W direction), the magnetic flux concentrates on the inner magnetic shield 8 and the frame 5, so the shield effect in the space within enclosed by these members is substantial.

When the color cathode ray tube is disposed to face the north or the south (disposed in the N direction or the S direction), the inner magnetic shield 8 is open in the direction of the phosphor screen 3, so the magnetic shield effect is less than when the cathode ray tube is in the E or W direction. Thus, the magnetic shielding effect is different between the E and W direction and N and S directions. In other words, the magnetic shielding effect has an anisotropy. It Is however desirable that the magnetic shielding effect is approximately equal in all directions. However, with the magnetic shield 8 in the shape of the frustum of pyramid, it is not possible to independently adjust the magnetic shield effect in the E and W directions, and the N and S directions, and the designing is made based on experience.

When the inner magnetic shield is not provided, the bending of the electron beam path due to the environmental magnetic field when the cathode ray tube is in the E or W direction is in the vertical direction. So, with a type of cathode ray tube having phosphor stripes elongated in vertical direction, the deviation of the electron beam impinging positions in the vertical direction do not cause serious color contamination. When however the magnetic shield 8 in the shape of a frustum of pyramid as shown in FIG. 11 is used (to improve the shield effect for the cathode ray tube in the N or S direction), if the cathode ray tube is in the E or W direction, the magnetic shield 8 not only gives the desired shielding effect, but also modifies the environmental magnetic field. The shield effect for the cathode ray tube in the E or W direction may therefore be inferior than if the magnetic shield 8 is not used at all. It often happens that the intended improvement in the magnetic shielding is not attained.

The terrestrial magnetism as an environmental magnetic field consists of a horizontal components and a vertical components, and the effect of vertical component is constant regardless of the direction in which the cathode ray tube is disposed. The vertical component is substantially constant throughout a substantial part of the world, so the effect of the vertical component can be easily eliminated by appropriate design. The effect of the horizontal component of the terrestrial magnetism is more difficult to overcome.

Since the prior art color cathode ray tube is configured as described above, the shielding effect by means of the magnetic shield is insufficient, and it is not possible to determine or alter the shielding effect independently for the E and W directions, and for the N and S directions. Moreover, the designing was made by experience, and was time-consuming.

SUMMARY OF THE INVENTION

An object of the invention is to provide a color cathode ray tube utilizing the effects of the elongated shape of the magnetic body thereby to reduce the amount of miss-landing or deviation in the position of the impingement of the electron beam that is due to the external magnetic field in one direction, and that can be designed with ease.

A color cathode ray tube according to the invention comprises:

- an envelope having a generally rectangular front panel;
- a phosphor screen provided on an inner surface of said front panel;
- an electron gun disposed to face the phosphor screen and emitting an electron beam toward the shadow mask;
- a shadow mask disposed to face said phosphor screen and having apertures for passage of an electron beam;
- a frame for reinforcing the periphery of the shadow mask and fixing the shadow mask with respect to the inner surface of said front panel; and
- a magnetic shield comprising a strip of a magnetic material having a first end fixed to said frame and a second end disposed closer to said electron gun.

Because of the elongated shape, the strip is magnetized easily only in the direction of its length, so an external magnetic field in the direction parallel to the length of the strip is reduced or canceled, while an external magnetic field normal to the length of the strip is not affected. In other words, the shielding effect is attained when the external magnetic field is parallel to the length of the strip, while there is no adverse effect when the external magnetic field in the direction normal to the length of the strip.

By bending the second end of the strip so that its tip is directed to a plane containing the tube axis and parallel to the longer sides of the shadow mask, an external magnetic field in the direction normal to said plane is enhanced, and the deviation in the electron beam path is further reduced.

The effect of the elongated shape of the strips is better exhibited by determining the length, thickness and width as set forth above.

By fixing the magnetic shield such that it is inclined with respect to the frame and by forming the magnetic shield into a strip shape which does not have any bent part in the middle, the strip of the magnetic shield can be accommodated even when the space between the inner surface of the funnel of the tube and the range over which the electron beam is deflected is limited, without interfering with the path of the electron beam. With this structure, the desired effect of the elongated shape is obtained.

By connecting the tips of a plurality of magnetic shields by means of a non-magnetic member, the mechanical strength of the tips is increased, and vibration and deformation due to contact with other bodies by impact or during manufacture can be prevented.

DETAILED DESCRIPTION OF THE PREFERRED EMBODIMENTS

Embodiments of the invention will now be described with reference to the drawings.

Figure 1:
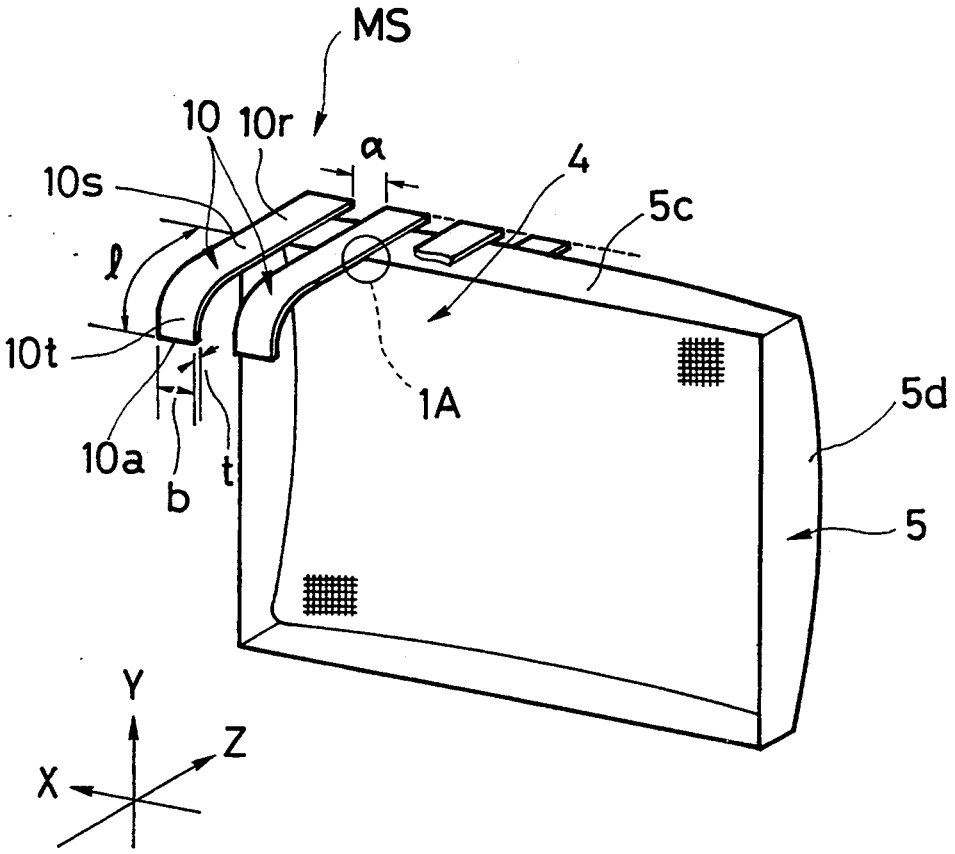
FIG. 1 is a perspective view showing a pertinent portion of the cathode ray tube of an embodiment of the invention.
Figure 1A:
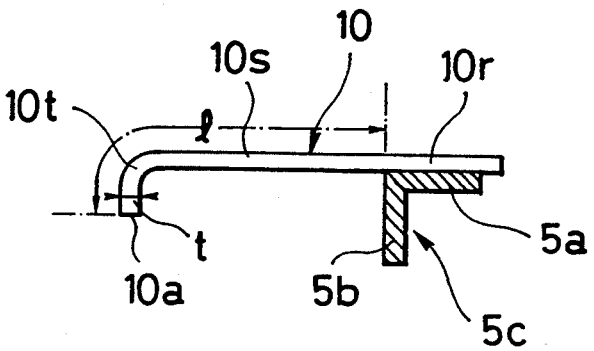
FIG. 1A is an enlarged sectional view of part 1A in FIG. 1.
Figure 11:
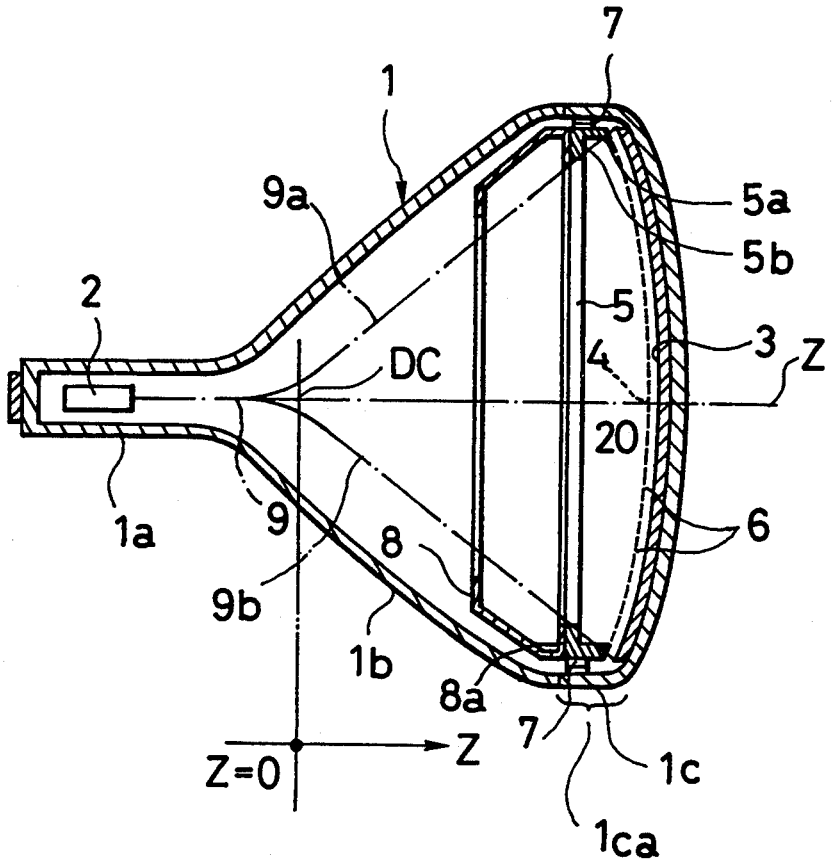
FIG. 11 PRIOR ART
FIG. 11 is a sectional view showing a cathode ray tube in the prior art.

FIG. 1 shows a pertinent portion of an embodiment of the invention. FIG. 1A shows, in enlarged cross section, part 1A in FIG. 1. The cathode ray tube of this embodiment is a 20-inch color cathode ray tube, and its general configuration is similar to that shown in and described with reference to FIG. 11. In FIG. 1 and FIG. 1A, members or parts identical to those in FIG. 11 are denoted by identical reference numerals. A distinction of this embodiment from the prior-art cathode ray tube of FIG. 11 is that it comprises a magnetic shield MS consisting of a plurality of strips 10, details of which will be described later.

Figure 12:
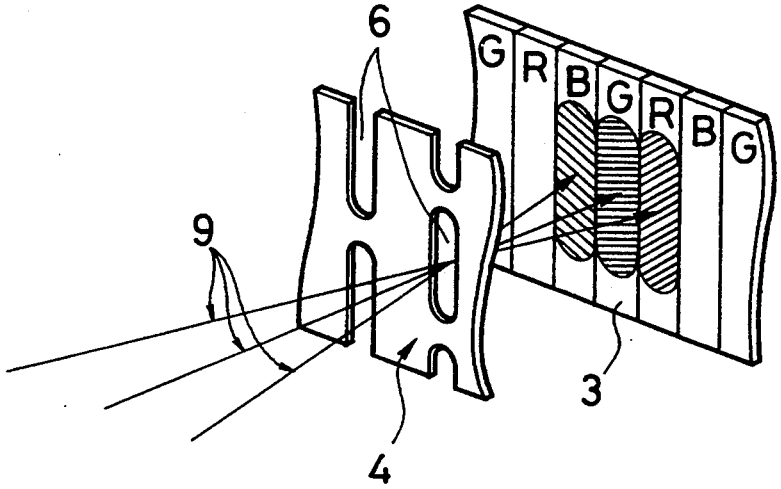
FIG. 12 PRIOR ART
FIG. 12 is an enlarged view showing phosphor stripes and apertures in a shadow mask.

The shadow mask 4 is provided with a multitude of elongated apertures 6 each extending in the Y axis direction, as is shown in FIG. 12.

The magnetic shield MS comprises 34 strips in all, 17 strips along each of the longer sides, i.e., the top and the bottom sides of the frame 5, at an equal interval of 1 cm.

Part only of the strips 10 along the top side 5c are illustrated: illustration of others is omitted as they are formed and mounted in a similar manner.

Each of the strips 10 is substantially J-shaped, and is conveniently formed from a continues strip but may be considered to be composed of a root part 10r, a trunk part 10s and a curved tip part 10t, for the purpose of explanation. The root part 10r is fixed to the top side 5c of the frame 5. The trunk part 10s is continuous to the rear end (the end toward the electron gun 2) of the root part 10r, and extends rearward (i.e., toward the electron gun 2) in parallel with the Z-axis.

The tip part 10t continues to the rear end of the trunk part 10s and bent so that the tip or free end 10a of the strip 10 is directed toward the X-Z plane (where Y=0).

As an example, the thickness t of the strip 10 is 0.1 cm and its width b is 1 cm. The total length l of the trunk part 10s and the tip part 10t is 10 cm, as indicated in FIG. 1 and FIG. 1A. The length of the tip part 10t is about ⅓ of the length of the trunk part 10s.

The tip 10a of the tip part 10t is not magnetically connected to any other high-permeability material.

The strips 10 should be formed of a magnetic material having as high a permeability as possible, and as little residual magnetism as possible, ideally no residual magnetism.

Let us first assume that the cathode ray tube is disposed in the N or S direction, that is the external magnetic field is parallel with the Z axis. The strips 10 are magnetized along their length, and the magnetized strips create an induced magnetic field around them. The induced magnetic field near the tip of each strip is toward or away from the tip. The principal component of such a magnetic field around the tip part 10t is in the direction in which the tip 10a is directed, i.e., in the Y axis direction. The magnetization of the strips 10 therefore enhance the magnetic field or the magnetic field component in the Y direction.

On the side of each strip, the direction of the induced nagnetic field is opposite to the external magnetic field. Accordingly, in the region where the electron beam would pass, which is surrounded by the strips 10, the magnetic field induced by the magnetized strips is in the direction opposite to the external magnetic field, and the induced magnetic field and the external magnetic field cancel each other, at least partially. In this way, the magnetic field in the Z axis direction is reduced, and a magnetic shielding effect is exhibited.

Further explanation is given with reference to the results of experiments. In FIG. 12, the phosphor screen 3 in the form of stripes comprises blue phosphor array B, red phosphor array B and green phosphor array G, and the electron beam apertures 6 formed in the shadow mask 4 are formed to correspond to the phosphor arrays B, R and G. The electron beam 9 emitted From the electron gun 2 passes the apertures 6 and impinges on the phosphors B, R or G to cause emission of light of the desired color.

In a color cathode ray tube having a stripe-type phosphor screen 3, when the electron beam 9 deviates in the Y direction under the influence of the terrestrial magnetism, the electron beam 9 will impinge on the phosphor of the same color, so the color impurity is not degraded. However, when the electron beam 9 deviates In the X direction under the influence of the Lorenz's force caused by the external magnetic field such as terrestrial magnetism, the electron beam may impinge partly or entirely on an area outside the phosphor of the desired color. This result in color contamination. The Lorenz's force F exerted on the electrons moving at a speed V in the magnetic field of the flux density B is given by:

$$F=-e(V\times B) \tag{1}$$

In the above equation, "−e" represents the electric charge of an electron, V is a vector notation of the velocity of the electron, and B is a vector notation of the magnetic flux density in the region where the electron travels.

The X direction component of the Lorenz's force (component in the X axis) Fx is given by:

$$Fx=-e(Vy\cdot BZ-Vz\cdot By) \tag{2}$$

In the above equation, Vy and Vz are components of the velocity V in the Y and Z directions, and By and Bz are components of the magnetic flux density B in the Y and Z directions. As Fx is made smaller, the deviation of the electron beam in the X direction is reduced, and the color contamination is reduced.

Figure 6:
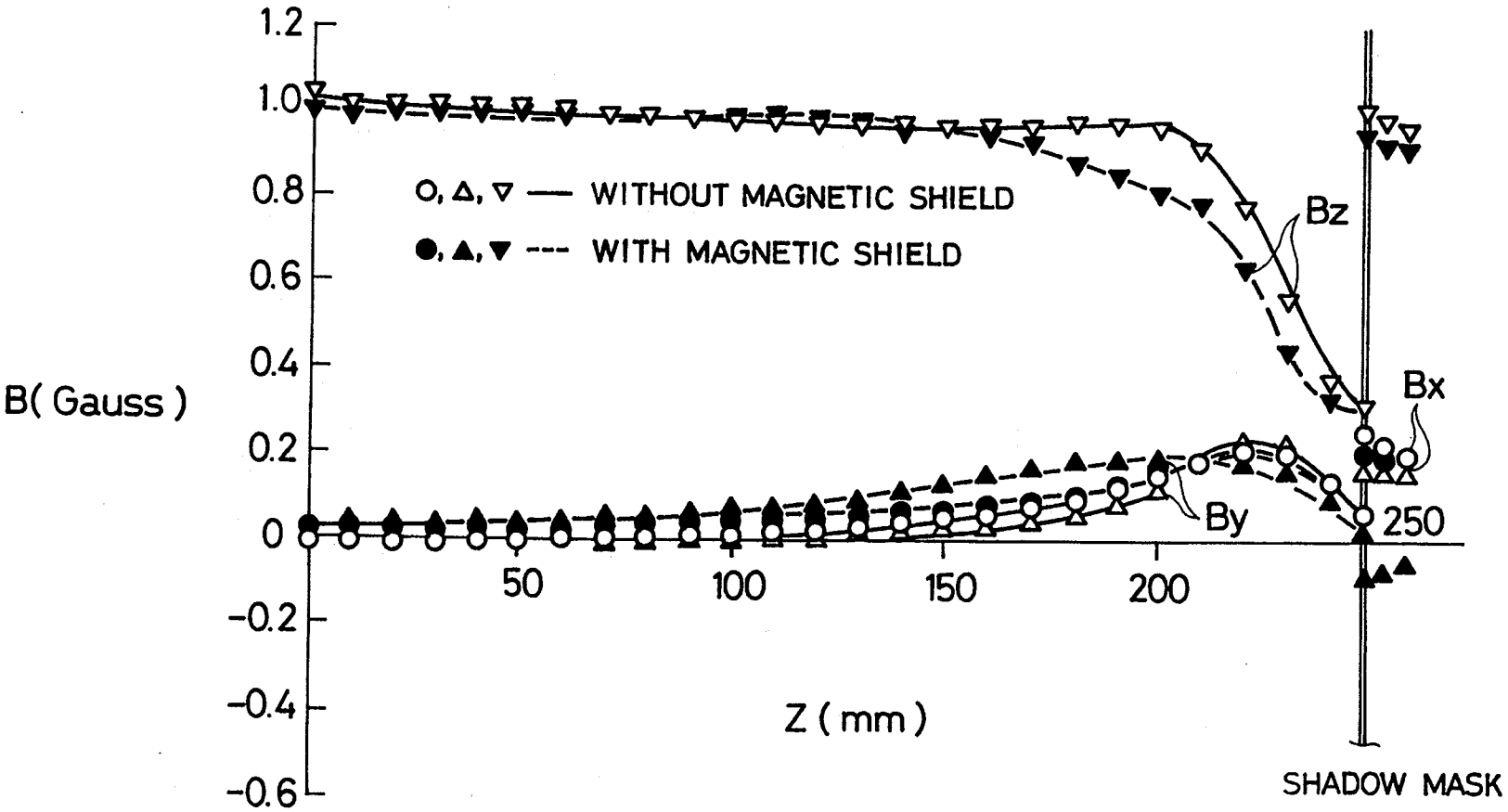
FIG. 6 is a graph which shows results of measurements of magnetic flux density distribution that are obtained when an external magnetic field is applied in the longitudinal direction of the strips.

FIG. 6 shows the results of measurement of magnetic flux densities obtained by forming a situation simulating an actual cathode ray tube having a diagonal size of 20 inches. That is, the shadow mask 4 and the frame 5 are disposed at the same relative position as in a completed cathode ray tube. For assessing the effect of the magnetic shield some of the measurements were carried out without the magnetic shield MS, while other measurements were carried out with the magnetic shield MS provided.

The magnetic flux density is measured at various positions along the electron beam trajectory within a space in a cathode ray tube. The position in FIG. 6 indicates the distance in the Z direction from a deflection center DC (FIG. 11). The deflection center DC is a point from which the electron beam 9 appears to fan out as seen from outside the region where the deflection takes place. The deflection is caused by the use of deflection coils (not shown). A magnetic field corresponding to an environmental magnetic field of 1.0 oersted (the magnetic flux density being 1.0 gauss) in the Z direction is applied (while the effect of the terrestrial magnetism in the X and Y directions is removed). This can be achieved by placing the entire system in a space about which a Helmholtz coil is wound, and passing an electric current through the coil to generate a magnetic field in the coil.

The actual terrestrial magnetism is on the order of 0.5 oersted, but for the purpose of improving the measurement accuracy (i.e., for enlarging the miss-landing to thereby facilitate the measurement), a larger value (1.0 oersted) is used.

Figure 5:
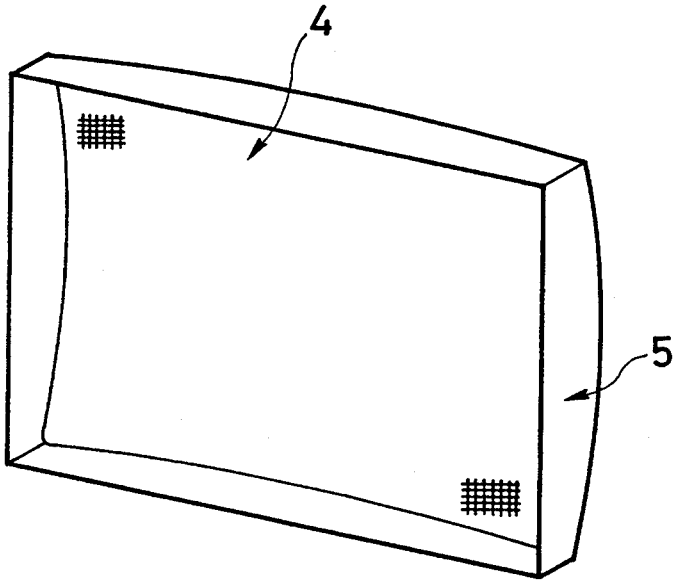
FIG. 5 is a perspective view showing a shadow mask and a frame.

Blank circles, triangles, and inverted triangles indicates the magnetic flux density components Bx, By and Bz in the X, Y and Z directions that are obtained when the magnetic shield MS is not provided as shown in FIG. 5.

In FIG. 6, in the region from the deflection center (DC where Z=0) to a point Z=200 mm, the magnetic flux consists mainly of the Z-axis component Bz. In the region closer to the shadow mask 4, the Z-axis component Bz is reduced, and Y-axis and X-axis components By and Bx are increased. On the whole, Bz>>By and the Lorenz's force in the X direction is dominating. Calculation of the path of the beam 9 of electrons moving in a magnetic field of such a distribution indicates that the miss-landing amount at the corner part of the phosphor screen 3 is 147 μm. If the external magnetic field is 0.5 oersted, i.e., half the magnetic field used for time experiment, the miss-landing is 147/2=73.5μ, which is completely out of the intended phosphor stripe. In order to reduce the Lorenz's force component Fx, time magnetic field should be so modified that Bz and By are approximately equal to each other, as will be understood from time equation (2). In other words, Bz should be decreased, and By should be increased. Moreover, as the polarity (sign "+" or "−") of Vy is opposite between the upper half and time lower half of the tube, the polarity of By should be opposite.

Figure 7A:
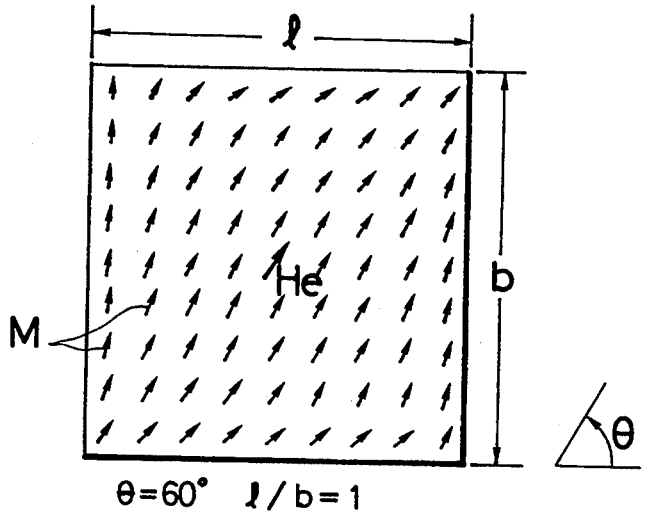
FIG. 7A to FIG. 7D are diagrams for explaining the effect of the shape of the magnetic body.
Figure 7B:
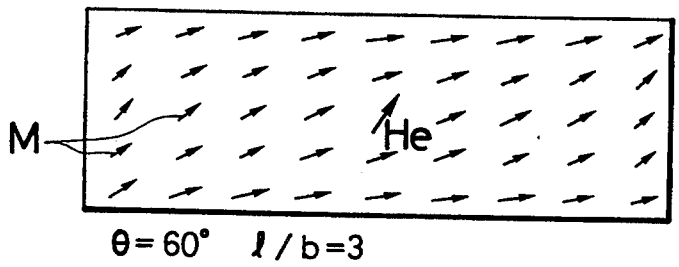
Figure 7C:
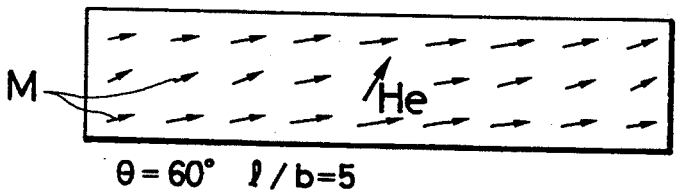
Figure 7D:
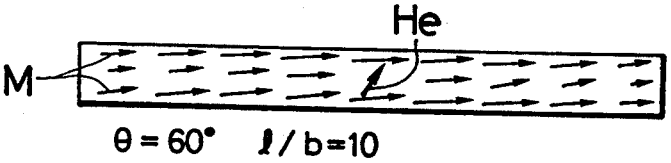

When a ferromagnetic body is magnetized by an external magnetic field, the magnetization depends largely on the shape of the ferromagnetic body. For instance, FIG. 7A to FIG. 7D are vector representation of the distribution of magnetization of a flat magnetic body resulting from application of an external magnetic field He at an angle of $\theta=60°$ with respect to the longitudinal direction of a ferromagnetic body having various length l and width b. The magnetization is calculated by an integral equation method. In the case of a square (l/b=1) as shown in FIG. 7A, the direction of the magnetization M and the direction of the external magnetic field He are identical. As l/b is increased, as shown in FIG. 7B, FIG. 7C and FIG. 7D, the direction of the magnetization M is shifted toward the longitudinal direction.

Figure 8A:
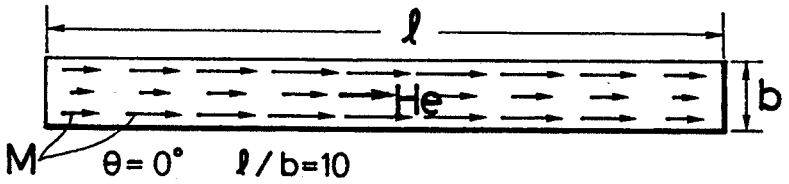
FIG. 8A to FIG. 8C are diagrams which show, by vector representation, distribution of magnetization obtained as a result of calculation by means of an integral equation method, on the assumption that an external magnetic field is applied at different angles with respect to the longitudinal direction of an elongated magnetic body.
Figure 8B:
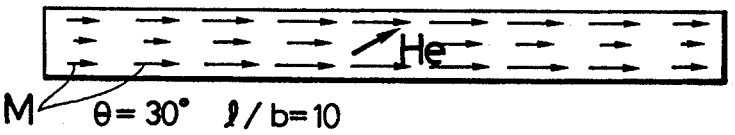
Figure 8C:
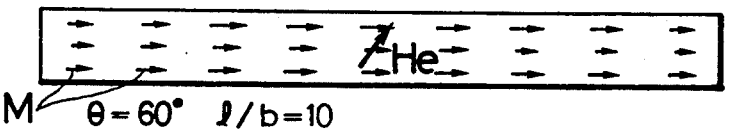

FIG. 8A, FIG. 8B and FIG. 8C are vector representation of the distribution of magnetization of a ferromagnetic body of l/b=10, resulting from application of all external magnetic field lie at various angles $\theta=0°$, 30° and 60° . The magnetization is calculated by an integral equation method. As will be seen, when l/b is large, i.e., when the ferromagnetic body is more elongated, the magnetization M is in the longitudinal direction regardless of the direction of the external magnetic field He applied. This is called a shape effect, which is an anisotropy due to the elongated shape of the magnetization of magnetic bodies. The apparent permeability $\mu'$, a demagnetizing factor N and the permeability $\mu$ of the magnetic body of a given shape are related as follows:

$$\mu'=1/(1/\mu+N/4\pi) \quad (3)$$

In an elongated flat magnetic body, the demagnetizing factor Nl in the longitudinal direction is sufficiently smaller than the demagnetizing factor Nb in the width direction, i.e., $$Nl<<Nb$$

Accordingly, the apparent permeability $\mu'$ in the longitudinal direction is sufficiently larger than the apparent permeability $\mu b$ in the width direction, i.e., $$\mu' l>>\mu' b$$

Accordingly, the longitudinal direction is the direction of easy magnetization. Where the magnetic body is made of pure iron, the principal component of magnetization is in the longitudinal direction, i.e., the magnetization tend to be concentrated in the longitudinal direction if l/b is 3 or more, unless the magnetic field is perpendicular to the longitudinal direction, and when l/b>20, there is essentially no magnetization other than in the longitudinal direction.

Figure 9A:
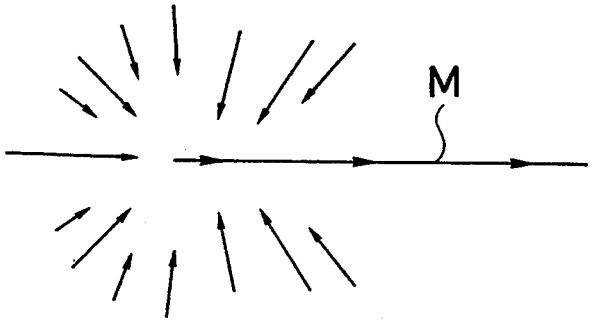
FIG. 9A to FIG. 9C are diagrams showing magnetic fields around tips of an elongated magnetic body magnetized in their longitudinal direction.
Figure 9B:
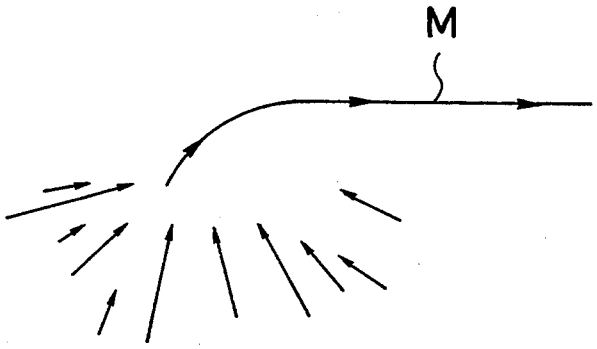
Figure 9C:
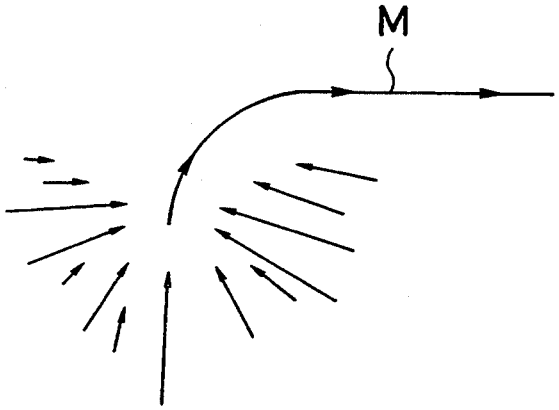

FIG. 9A to FIG. 9C are vector representation of the induced magnetic field around one end (left end) of a strip-shaped magnetic body 0.1 cm thick, 1 cm wide and 10 cm long, when a magnetic field is applied in the horizontal direction (side-to-side direction in the figures) . In FIG. 9A, the strip-shaped magnetic body is straight and disposed to extend in the horizontal direction. In FIG. 9B and FIG. 9C, the elongated sheet-shaped magnetic body has a bent end, with the trunk portion extending horizontally. Since the length is much greater than the thickness, because of the shape effect, the magnetization M is along the length of the magnetic body. An induced magnetic field is created around the tip (left end). In the case of FIG. 9C, the direction of the induced magnetic lines of force are mainly in the Y direction (vertical direction). That is, when an elongated magnetic body is magnetized by an external magnetic field, it is magnetized according to the shape of the body, and creates an induced magnetic field around it. If this characteristic is utilized, the control over the magnetic field distribution is possible.

Solid (black) circles, triangles and inverted triangles in FIG. 6 show Bx, By and Bz obtained by measurements similar to those described above (in connection with the blank circle, triangle and inverted triangle), but with the magnetic shield MS comprising the J-shaped strips 10. It will be observed by comparison with the blank circles, triangles and inverted triangles that Bz is reduced, By is increased within the range of Z=0 to 200 mm, and the magnetic field distribution has thus been changed. The miss-landing amount of the electron beam 9 at the corner part of the phosphor screen as obtained by calculation of the path of the electron beam 9 in the magnetic field is 77 μm. This is much smaller than the miss-landing amount (147 μm) that results when the strips 10 are not provided. Optimum designing can be achieved, in which the dimension and disposition of the strips 10 so adjusted as to control the magnitude of the induced magnetic field, and as to minimize the miss-landing amount due to the magnetic field in the Z direction.

Figure 10:
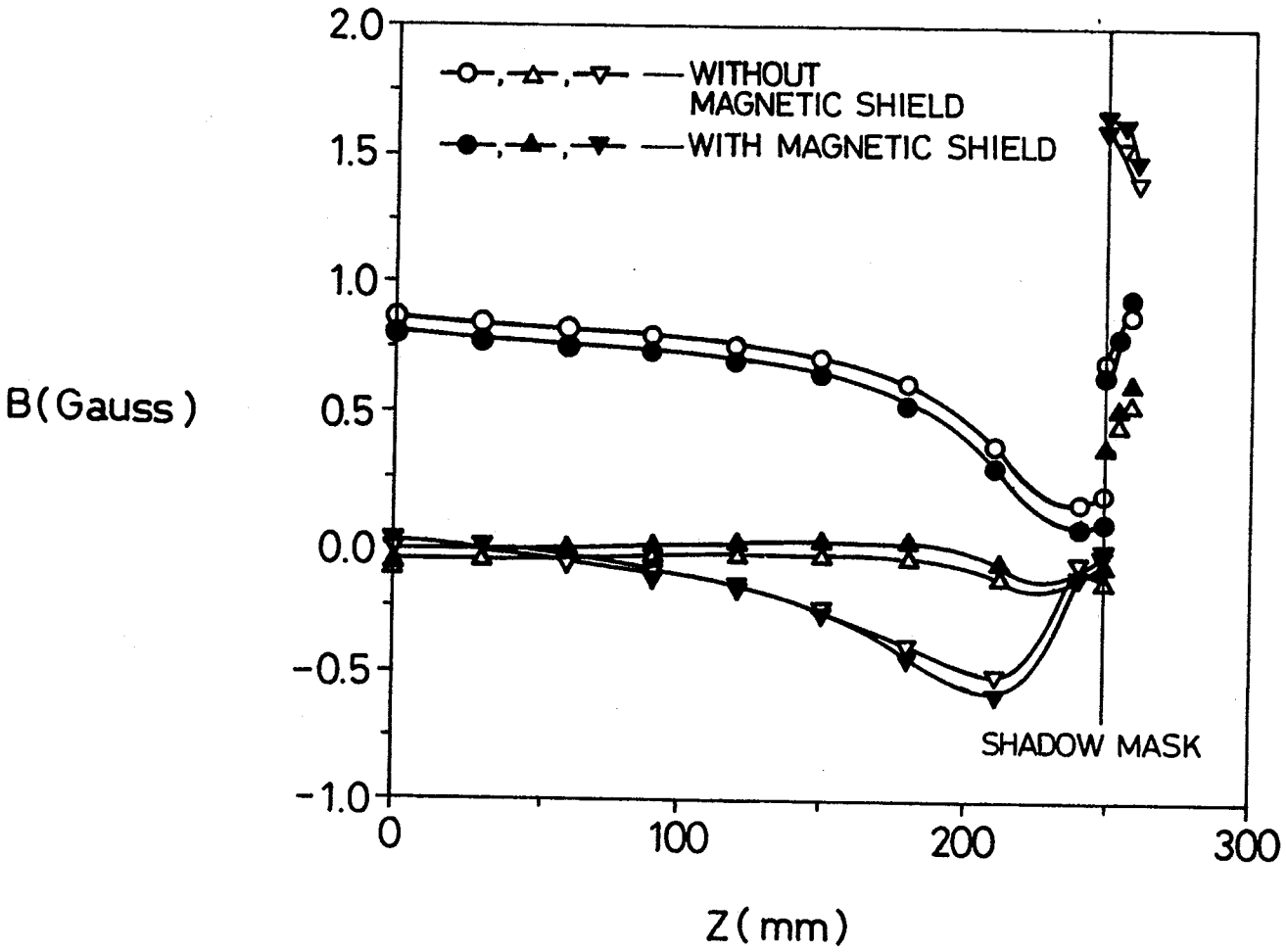
FIG.10 is a graph which shows results of measurements of magnetic flux density distribution that results when an external magnetic field is applied in the lateral direction of the strips.

FIG. 10 shows the results of measurements similar to the measurements whose results are shown in FIG. 6. The difference is that the external magnetic filed in applied in the X direction, rather than in the Z direction. The blank circles, triangles, and inverted triangles indicate the results obtained when the shield MS is not provided, and the solid circles, triangles and inverted triangles indicate the results obtained when the shield MS is provided. In both cases, the circles, triangles and inverted triangles indicate Bx, By and Bz. It will be seen that presence of the magnetic shield MS little affect the magnetic flux or its distribution. This is because the strips 10 of the magnetic shield MS are not magnetized by the application of a magnetic field in their width direction, and the interval $\alpha$ between adjacent strips 10 provides a large magnetic resistance against a magnetic field in the X direction, and no magnetic closed circuit is formed.

If the magnetic shield 8 were not provided in the cathode ray tube shown ill FIG. 11, the bending of the electron beam 9 due to the magnetic field in the X direction is mainly in the Y direction, because of the Fleming's law, and there will be no color contamination if the phosphor screen 3 is of the stripe-type. In this state, however, when the magnetic field is applied in the Z direction, the miss-landing is in the X direction, resulting in color contamination. The internal magnetic shield 8 is mounted for preventing such color contamination. The magnetic shield 8 also has certain shielding effect against the magnetic field in the X direction, but it also has the effect of varying the magnetic field in the tube, with the result that the magnetic shield 8 is better not provided for the X direction magnetic field. It is therefore difficult to reduce the color contamination due to the magnetic fields in both of the Z and X directions.

In contrast, in the above embodiment, the J-shaped magnetic shields 10 having a sufficient length and disposed at an interval $\alpha$, give no or little effect on the X direction environmental magnetic field, and exhibit a shielding effect against the Z direction environmental magnetic field. Moreover, the tip parts 10*t* of the strips 10 are bent so that the tips 10*a* are directed toward the X-Z plane (where Y=0), as shown in FIG. 1, the magnetic field in the Z direction is transformed into the magnetic field in the Y direction, so that the effect of the Z direction environmental magnetic field is further reduced.

Also known in the art is a modification of the conventional internal magnetic shield 8 shown in FIG. 11, in which the end of the shield 8 on the entrance side are bent in the direction of the tube axis in an attempt to eliminate the effects of the environmental magnetic field in a specific direction. This arrangement is effective when the environmental direction is in the specific direction, but if the environmental direction is other direction, the results were worse than if the shield is not provided. The strips 10 shown in FIG. 1 are not associated with such a problem.

The range over which the parameter in designing the strips 10 can be varied will now be discussed. The strips 10 are disposed on the periphery of the shadow mask 4, each strip is formed of a magnetic body having one end fixed to the frame 5, and having the other end situated nearer to the electron gun 2. In order to exhibit the shape effect explained with reference to FIG. 7, the ratio of the length l to the width b should be not less than 2, and preferably not less than 3. Since such shape effect is derived even from a single strip 10, a plurality of such strips 10 need not be provided along the entire side or along the entire corner part of the frame 5. However, in practice, a plurality of strips 10 need to be provided along one side or along one corner because the shielding effect is required over a certain area of the phosphor screen. The interval $\alpha$ between the adjacent strips 10 should be substantially greater than the thickness t (the dimension normal to the side wall side of the frame 5). In general, the inequality $\alpha/t>>3$ should be satisfied.

In the embodiment of FIG. 1, Bz is transformed into By. This transformation effect is eminent because, in addition to the extension of the strips in the Z direction, the tip parts 10*t* are bent so that the tips 10*a* are directed toward the X-Z plane (Y=0). To obtain this effect sufficiently, the length of the strips 10 should be sufficiently larger than the thickness, as was explained with reference to FIG. 9. In the embodiment shown In FIG. 1, the relationship $l/t \geqq 5$ should be satisfied, and preferably, $l/t \geqq 10$ should be satisfied. The relationship $l/b \geqq 2$ should also be satisfied.

In the embodiment described, the tip part is curved smoothly. But the tip part may be bent sharply, and results similar to those of the above-described embodiment are obtained.

Figure 2:
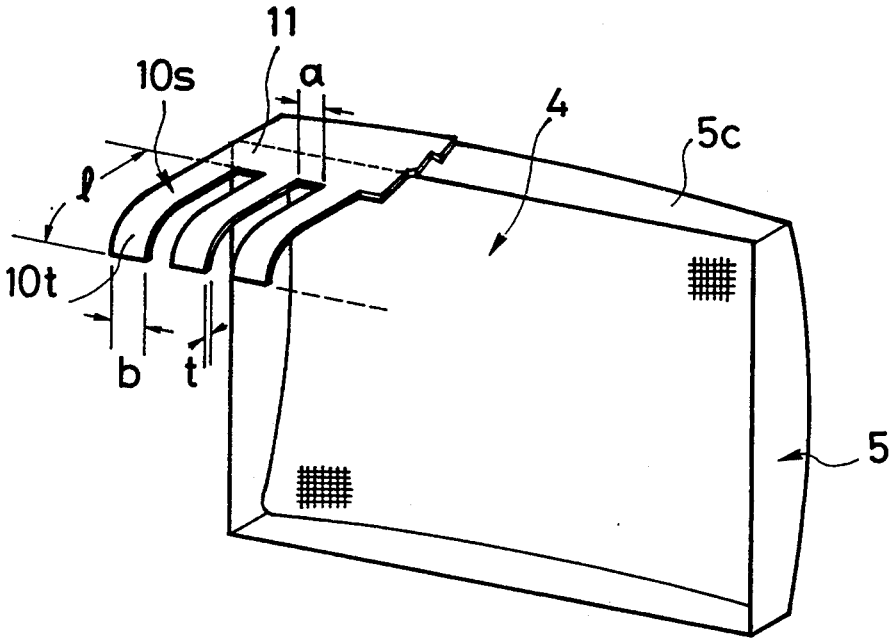
FIG. 2 is a perspective view showing a pertinent portion of the cathode ray tube of another embodiment.

FIG. 2 is a perspective view showing the pertinent part of the color cathode ray tube of another embodiment of the invention. The parts and members identical to those in FIG. 1 are identified by the same reference numerals and their description is omitted. The difference of this embodiment from the embodiment of FIG. 1 is that strips 10 does not have individual root parts 10*r*, and instead a common connecting part 11, which may be considered as a common root part, and which is common to all the strips 10 along each of the longer sides of the shadow mask, is provided and fixed to the longer side wall 5*c* of the frame 5. Each strip 10 comprises a trunk part 10*s* and a curved tip part 10*t* , and front ends of trunk parts 10*s* of strips 10 are continuous to a rear edge of the connecting part 11.

All the strips 10 and the connecting part 11 along each longer wall 5*c* of the frame 5 may be formed by blanking a single sheet.

This configuration has an advantage that the strips 10 are supported with a greater mechanical strength. The relationships $l/t \geqq 5$, $l/b \geqq 2$ and $\alpha/t \geqq 3$ should also be satisfied.

Figure 3:
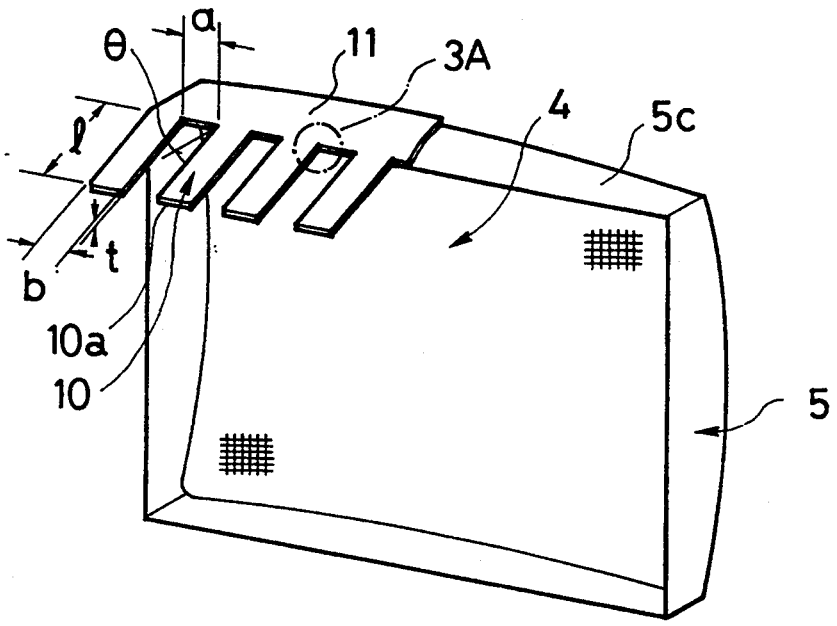
FIG. 3 is a perspective view showing a pertinent portion of the cathode ray tube of a further embodiment.
Figure 3A:
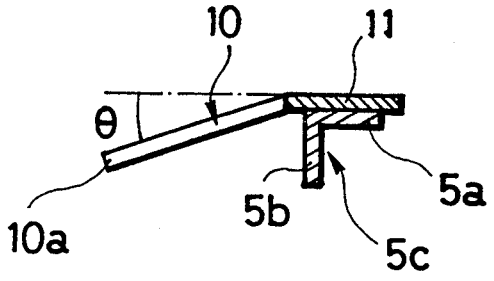
FIG. 3A is an enlarged sectional view of part 3A in FIG. 3.

FIG. 3 is a perspective view showing the pertinent part of the color cathode ray tube of a further embodiment. FIG. 3A shows, in enlarged cross section, part 3A in FIG. 3. The parts and members identical to those in FIG. 2 are identified by the same reference numerals and their description is omitted. The difference of this embodiment from the embodiment of FIG. 2 is that the strips 10 are at an angle of inclination $\theta$ with respect to the longer side wall 5*c* which is normal to the Y axis, and the strips 10 are straight, and are not bent in the middle. The front ends of the strips 10 are continuous to the connecting part 11 with an angle of inclination $\theta$.

According to the embodiment of FIG. 3 and FIG. 3A, the effect due to the bent rear ends as explained with reference to FIG. 9B and FIG. 9C, is not obtained, but because of the angle of inclination $\theta$ with respect to the longer side wall side 5*c* of the frame 5, a similar effect (though with a lesser extent) is obtained. Moreover, the effect due to the elongated shape of the strips 10 as explained with reference to FIG. 8 is obtained. Because of the angle of inclination, the strips extend along the tapered funnel 1*b* so that the space inside the tube is fully utilized, while maximizing the effect of the elongated shape of the strips 10. The relationships $l/t \geqq 5$, $l/b \geqq 2$ and $\alpha/t \geqq 3$ should also be satisfied.

In another embodiment, not illustrated, the structure is similar to the embodiment of FIG. 3 and FIG. 3A, but strips 10 are not inclined but parallel to the Z axis. When the funnel 1*b* is not tapered in the region where the magnetic shield MS is provided, or when there is enough extra space between the region over which the electron beam is deflected and the inner surface of the funnel 1*b* , then the strips 10 may not be inclined and parallel to the tube axis. Such a configuration does not have the effect of enhancing the magnetic field in the Y direction, but it has the effect of reducing or canceling the magnetic field in the Z axis.

Figure 4:
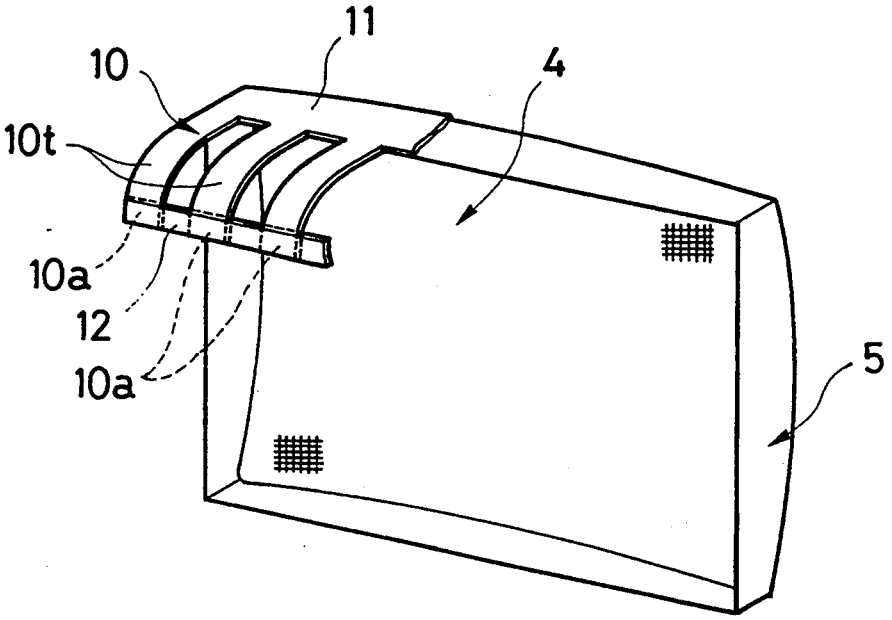
FIG. 4 is a perspective view showing a pertinent portion of the cathode ray tube of a further embodiment.

FIG. 4 is a perspective view of a pertinent portion of a color cathode ray tube of a further embodiment of the invention. In the figure, parts or members identical to those in FIG. 2 are denoted by identical reference numerals. The difference of this embodiment from the embodiment of FIG. 2 is that the tip parts 10*t* of the strips 10 are connected to each other by a non-magnetic member 12 to provide mechanical reinforcement. By virtue of the reinforcement, a slight impact or contact with other bodies during manufacture will not cause vibration or deformation (bending) of the tip parts 10*t* of the strips 10, so that the effects of the particular shape of the strips are ensured.

In the embodiments described, the strips 10 are mounted to the longer wall sides 5*c* of the frame 5. It is however possible to mount the strips 10 to the shorter wall sides 5*d* . All the strips 10 may not be identical in shape. What is essential is that each of the strips 10 satisfies the conditions described above. In particular, in or near the corner of the frame 5, the directions of the magnetic flux varies in a complex manner, so that it may be advantageous to vary the shape of the individual strips 10 to cancel or utilize the magnetic flux at the position of each strip 10.

The phosphor screen 3 may not be the stripe-type, but may be of the dot-type.

In the embodiments described, the frame 5 is generally formed of a material thicker than the shadow mask 4 for the purpose of supporting and reinforcing the shadow mask 4. In a small-sized color cathode ray tube, it is possible to bend the sheet which forms the shadow mask 4 so that the bent part will provide the functions of supporting and/or reinforcement. The strips 10 may then be mounted to such bent part of the shadow mask 4 providing the function of the frame. The term "frame" in the appended claims should therefore be construed to cover such part of the shadow mask providing the function of the support and/or reinforcement.

As has been described, according to the invention, one ends of elongated magnetic members of a high permeability is fixed, and the other end parts are disposed nearer to the electron gun, and the end of each of said other end parts forms a magnetic tip. Because of the effect of their elongated shape, the strips are magnetized in one specific direction, and the effect of the terrestrial magnetism or other environmental magnetic field in the specific direction, can be suppressed efficiently, without giving adverse effect in other, orthogonal direction, so that color contamination can be fully suppressed, and the performance of the color cathode ray tube is substantially improved. Moreover, the shielding effect in the E-W direction and the shielding effect in the N-S direction can be changed independently of each other. Accordingly, the designing is facilitated, and the cost of production can be lowered.

What is claimed is:

1. A color cathode-ray tube comprising:

an envelope having a generally rectangular front panel;

a phosphor screen provided on an inner surface of said front panel;

a shadow mask positioned to face said phosphor screen and having apertures for passage of an electron beam;

an electron gun positioned to face the phosphor screen and emitting an electron beam toward the shadow mask;

a frame for reinforcing the periphery of the shadow mask and fixing the shadow mask with respect to the inner surface of said front panel; and a magnetic shield comprising a plurality of strips of a magnetic material each of the strips having a first end fixed to said frame and a second end disposed closer to said electron gun;

wherein said second end of each of the strips is not in contact with a high-permeability magnetic member.

2. The tube of claim 1, wherein said strip is made of a high-permeability material, and having a ratio of its length to its thickness of not less than 5 and a ratio of its length to its width of not less than 2.

3. The tube of claim 1, wherein said strip is substantially straight and is inclined with respect to a plane containing an edge of the frame and parallel with an axis of the tube.

4. The tube of claim 3, wherein said strip extends along the inner surface of the funnel.

5. The tube of claim 1, wherein said strip has a trunk part having one end fixed to said frame and extending from the first part toward said electron gun, and a tip part coupled to the trunk part and having a tip directed toward a plane containing an axis of the tube and an axis perpendicular to the said axis of the tube and parallel to longer sides of the front panel.

6. The tube of claim 5, wherein said trunk part and said tip part are continuous and formed by bending a continuous strip.

7. The tube of claim 1, wherein said magnetic shield comprises a plurality of said strips.

8. The tube of claim 7, wherein the second ends of said the strips are connected together by means of a non-magnetic connecting member and are thereby reinforced.

9. The tube of claim 7, wherein said magnetic shield further comprises a connecting part extending along the side wall of the frame, and fixed to the frame, and the first ends of said strips are connected to said connecting part.

10. The tube of claim 7, wherein the frame is of a rectangular shape and there are at least two of said strips in physical contact with each of said walls.

11. The tube of claim 10 wherein there are a total of 34 strips and each of said strips are spaced from each other at an equal interval of 1 cm.

12. A color cathode-ray tube comprising:

an envelope having a generally rectangular front panel;

a phosphor screen provided on an inner surface of said front panel;

a shadow mask positioned to face said phosphor screen and having apertures for passage of an electron beam;

an electron gun positioned to face the phosphor screen and emitting an electron beam toward the shadow mask;

a frame for reinforcing the periphery of the shadow mask and fixing the shadow mask with respect to the inner surface of said front panel, said frame having a rectangular shape and having a top, bottom and side walls, a one piece monolithic magnetic shield comprising a connection part in direct physical contact with the frame and a plurality of strip parts common to and extending beyond the frame in the direction of said electron gun from the connection part wherein a tip part of each of said strips is not in contact with a high-permeability magnetic member.

13. The tube of claim 12 wherein the strip parts have a curved tip part remote from said connecting part.

14. The tube of claim 12 wherein said strip parts are bent adjacent to said connecting part to form an angle of inclination with the wall to which the connecting part is attached.

15. The tube of claim 12 wherein there are a total of 34 strips.

16. The tube of claim 13 wherein there are a total of 34 strips.

17. The tube of claim 14 wherein there are a total of 34 strips.

18. The tube of claim 1, wherein said plurality of strips are disposed on top and bottom sides of the frame.

19. A color cathode-ray tube comprising:

an envelope having a generally rectangular front panel;

a phosphor screen provided on an inner surface of said front panel;

a shadow mask disposed to face said phosphor screen and having apertures for passage of an electron beam;

an electron gun disposed to face the phosphor screen and emitting an electron beam toward the shadow mask;

a frame having four walls for reinforcing the periphery of the shadow mask and fixing the shadow mask with respect to the inner surface of said front panel; and a magnetic shield comprising at least one strip of a magnetic material having a first end fixed to and in physical contact with a wall of said frame and a second end disposed closer to said electron gun, the strip having a length and width, the width of the strip being substantially less than a major length of the wall of the frame to which it is attached, so that a plurality of strips can be attached to each of said walls.

20. The tube of claim 19, wherein there are a plurality of strips in contact with each of the walls of the frame.

* * * * *